US010655636B2

(12) United States Patent
Iwasaki

(10) Patent No.: US 10,655,636 B2
(45) Date of Patent: May 19, 2020

(54) CENTRIFUGAL AIR BLOWER

(71) Applicant: KEIHIN CORPORATION, Tokyo (JP)

(72) Inventor: Masaatsu Iwasaki, Ichikawa (JP)

(73) Assignee: KEIHIN CORPORATION, Tokyo (JP)

( * ) Notice: Subject to any disclaimer, the term of this patent is extended or adjusted under 35 U.S.C. 154(b) by 114 days.

(21) Appl. No.: 15/937,908

(22) Filed: Mar. 28, 2018

(65) Prior Publication Data

US 2018/0283396 A1 Oct. 4, 2018

(30) Foreign Application Priority Data

Mar. 30, 2017 (JP) ..... 2017-067139

(51) Int. Cl.
*F04D 29/42* (2006.01)
*F04D 29/28* (2006.01)

(52) U.S. Cl.
CPC ..... *F04D 29/4226* (2013.01); *F04D 29/422* (2013.01); *F04D 29/281* (2013.01); *F05B 2240/14* (2013.01)

(58) Field of Classification Search
CPC .. F04D 29/281; F04D 29/422; F04D 29/4226; F04D 29/441; F04D 17/04
See application file for complete search history.

(56) References Cited

U.S. PATENT DOCUMENTS 5,839,879 A * 11/1998 Kameoka ..... F04D 29/4233 415/206
7,500,825 B2 * 3/2009 Hanai ..... F04D 29/4233 415/204
8,591,177 B2 * 11/2013 Yokoyama ..... F01D 9/026 415/119
9,568,017 B2 * 2/2017 Hayashi ..... F04D 29/4213

FOREIGN PATENT DOCUMENTS

JP 07-167087 7/1995
JP 2015-214968 3/2015

OTHER PUBLICATIONS

Japanese Office Action with partial English translation dated Jul. 17, 2018, 5 pages.

* cited by examiner

*Primary Examiner* — Brian P Wolcott
(74) *Attorney, Agent, or Firm* — Rankin, Hill & Clark LLP

(57) ABSTRACT

A centrifugal air blower includes a lower case. The lower case includes a land part near a tongue part joining a discharge passage of a passage section and a spiral start position of a spiral passage. The land part protrudes toward an upper case. The height position of the land part is substantially the same as the height position of lower ends of blades. The land part includes a first wall which is vertically formed along an inner circumferential wall of the discharge passage, a second wall which is vertically formed on an outer circumferential side of an insertion hole and on a radially inward side of the first wall, and a ceiling covering upper ends of the first and second walls.

4 Claims, 4 Drawing Sheets

CENTRIFUGAL AIR BLOWER

CROSS-REFERENCE TO RELATED APPLICATION

This application is based upon and claims the benefit of priority from Japanese Patent Application No. 2017-067139 filed on Mar. 30, 2017, the contents of which are incorporated herein by reference.

BACKGROUND OF THE INVENTION

Field of the Invention

The present invention relates to a centrifugal air blower. More particularly, the present invention relates to a centrifugal air blower for use in an air-conditioning apparatus mounted in a vehicle.

Description of the Related Art

Conventionally, centrifugal air blowers including a fan having a plurality of blades, a motor for rotating the fan, and a casing surrounding the fan have been known.

In such centrifugal air blowers, for example, as disclosed in Japanese Laid-Open Patent Publication No. 2015-214968, an impeller and an electric motor are provided at the center of a casing, and under the rotating action of the impeller, an air is taken-in through a suction port opened in the casing. The air flows into a spiral air passage which is circumferentially formed around the impeller. Then, the air is discharged from a discharge port through a discharge air passage formed at the end of the spiral air passage.

SUMMARY OF THE INVENTION

In the centrifugal air blower of Japanese Laid-Open Patent Publication No. 2015-214968 described above, the air spirally flows toward the discharge air passage along the spiral air passage, so that the pressure of the air becomes high in the vicinity of the discharge port. Therefore, in an area around the electric motor, and in the vicinity of a tongue part provided between the winding start position of the spiral air passage and the discharge air passage, air containing moisture flows toward the inner side that is at low pressure. Consequently, there is a concern that the moisture in the air may infiltrate the electric motor provided on the inner side.

A general object of the present invention is to provide a centrifugal air blower which makes it possible to reliably prevent infiltration of the moisture contained in the air from a passage section into a drive source.

According to an aspect of the present invention, there is provided a centrifugal air blower including a casing, a fan housed in the casing and configured to take in an air in an axial direction and send the air in a radial direction, and a drive source housed in the casing and configured to drive the fan. The casing includes an air intake port opened at one end of the casing in the axial direction, a spiral first passage section formed on an outer circumferential side of the fan, a second passage section extending from a spiral end position of the first passage section to a discharge port, and a tongue part formed at a joined portion where a spiral start position of the first passage section and the second passage section are joined together. The centrifugal air blower further includes a first wall and a second wall provided adjacent to the tongue part. The first wall is vertically formed along an inner circumferential wall of the second passage section so as to extend toward the one end of the casing in the axial direction. The second wall is located radially inwardly of the first wall and vertically formed so as to face an outer circumferential surface of the drive source and extend toward the one end of the casing in the axial direction.

In the casing of the centrifugal air blower according to the present invention, the tongue part is formed at the portion joining the winding start position of the spiral first passage section with the second passage section extending to the discharge port. The first wall and the second wall are provided adjacent to the tongue part. The first wall is vertically formed along the inner circumferential wall of the second passage section so as to extend toward one end of the casing in the axial direction. The second wall is located radially inwardly of the first wall, and vertically formed so as to face the outer circumferential surface of the drive source and extend toward the one end of the casing in the axial direction.

Therefore, even in the case where part of the air flowing through the first and second passage sections flows from the second passage section under high pressure to the winding start position of the first passage section under low pressure, since the first and second walls are present, moisture or water contained in the air is prevented from infiltrating into the radially inward side. It is possible to reliably prevent infiltration of the moisture into the drive source provided on the radially inward side of the second wall.

The above and other objects features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
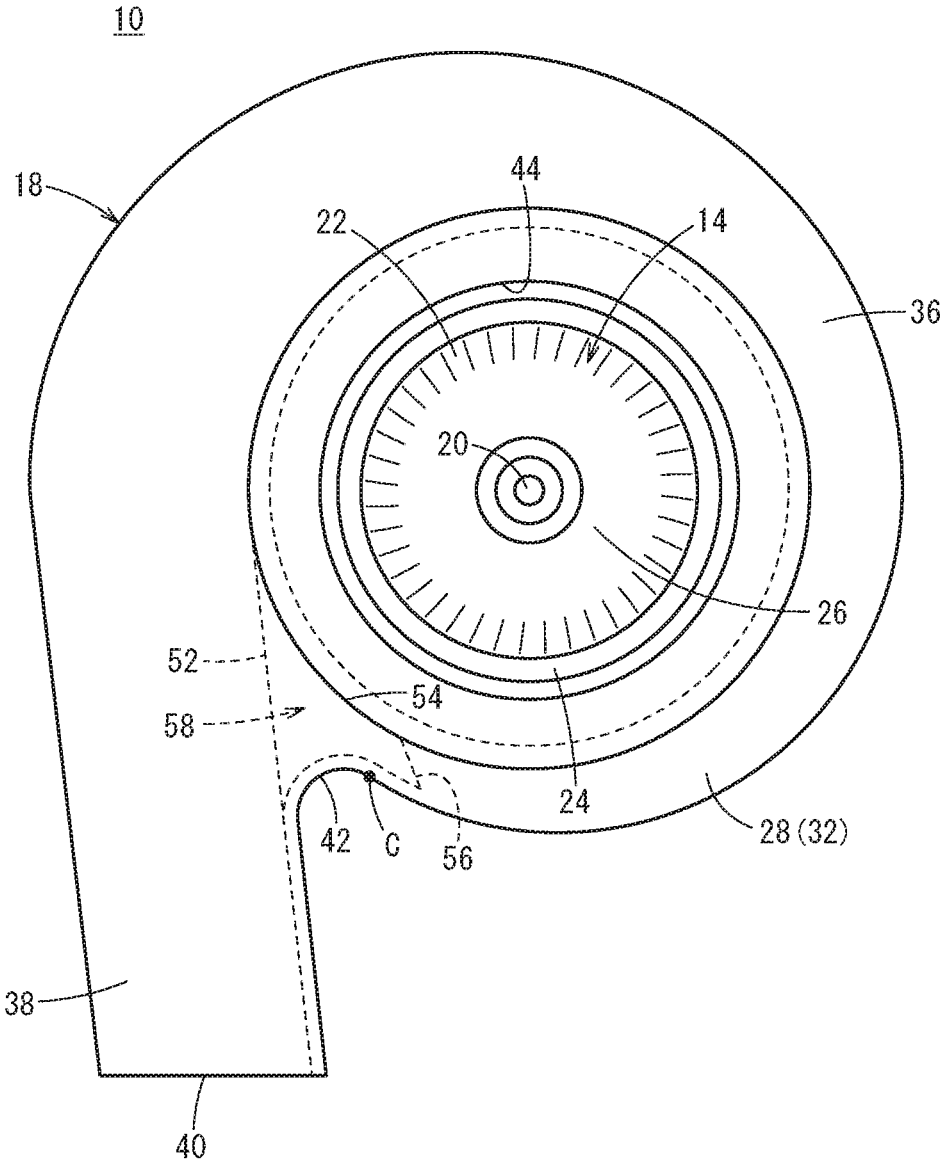
FIG. 1 is an overall plan view of a centrifugal air blower according to an embodiment of the present invention.
Figure 2:
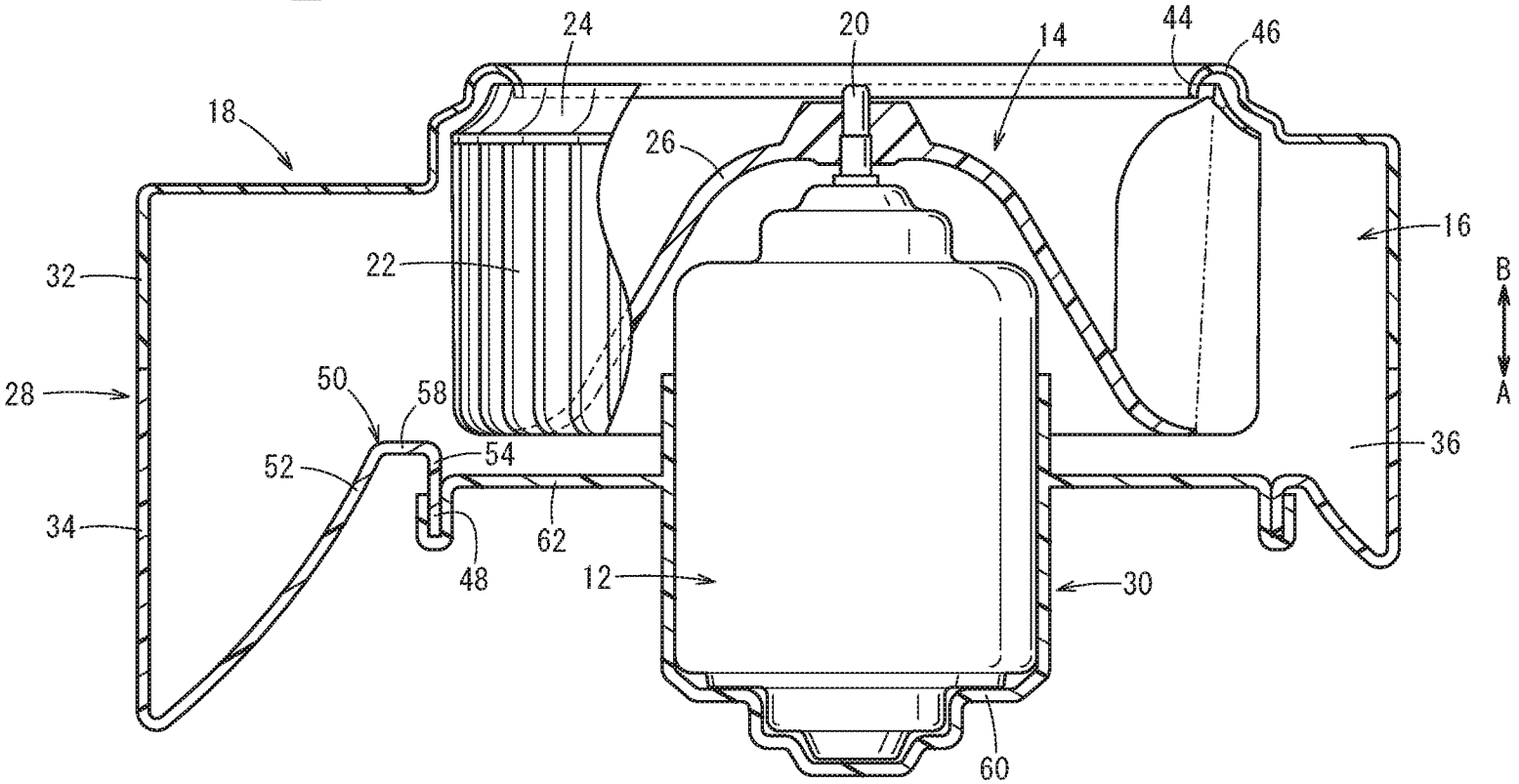
FIG. 2 is an overall longitudinal sectional view of the centrifugal air blower shown in FIG. 1.

As shown in FIGS. 1 and 2, this centrifugal air blower 10 includes a drive source 12 such as a motor, a fan 14 which rotates under driving action of the drive source 12, and a casing 18 containing the fan 14 and having a passage section 16 through which air flows.

For example, the drive source 12 is provided at a substantially lower central position of the casing 18. The drive source 12 is fixed to the casing 18 such that a rotary shaft 20 of the drive source 12 protrudes into the casing 18. The rotary shaft 20 is coupled to the central portion of the fan 14, and rotates together with the fan 14 by supplying electricity to the drive source 12.

The fan 14 is housed substantially centrally in the casing 18. The fan 14 includes a plurality of blades 22 arranged along the circumferential direction and spaced from each other at equal angular intervals, an annular shroud 24 provided on upper ends of the blades 22, and a boss 26 extending from lower ends to upper ends of the blades 22 toward the center.

The blades 22 are curved in cross section, and extend vertically (in directions indicated by arrows A and B) by a predetermined distance. The plurality of blades 22 are arranged along the circumferential direction, and are spaced from each other at equal angular intervals. The shroud 24 is coupled to the upper ends of the blades 22, and an outer marginal portion of the boss 26 is coupled to lower ends of the blades 22, to thereby form the fan 14 having a substantially cylindrical shape.

The boss 26 of the fan 14 is inclined downward (in the direction indicated by the arrow A) from the center toward the outer circumferential side. The center of the boss 26 is coupled to the rotary shaft 20 of the drive source 12, whereby the fan 14 and the drive source 12 are rotated together. The air taken in the inside of the fan 14 is guided downward (in the direction indicated by the arrow A) and to the outer circumferential side of the fan 14 along the boss 26. Then, the air is sent out to the outer circumferential side through gaps between the blades 22.

The casing 18 includes a casing main body 28 and a holder 30. For example, the casing main body 28 is formed at substantially the central part of the casing 18, and houses the fan 14. The holder 30 is provided at substantially the lower central position of the casing main body 28, and receives and holds the drive source 12.

The passage section 16 is formed in the casing main body 28 so as to circle the outer circumferential side of the fan 14 housed in the casing main body 28. The casing main body 28 includes an upper case 32 provided at an upper part of the casing main body 28 in the axial direction, and a lower case 34 connected to a lower portion of the upper case 32. The fan 14 is housed centrally in the casing main body 28.

Figure 3:
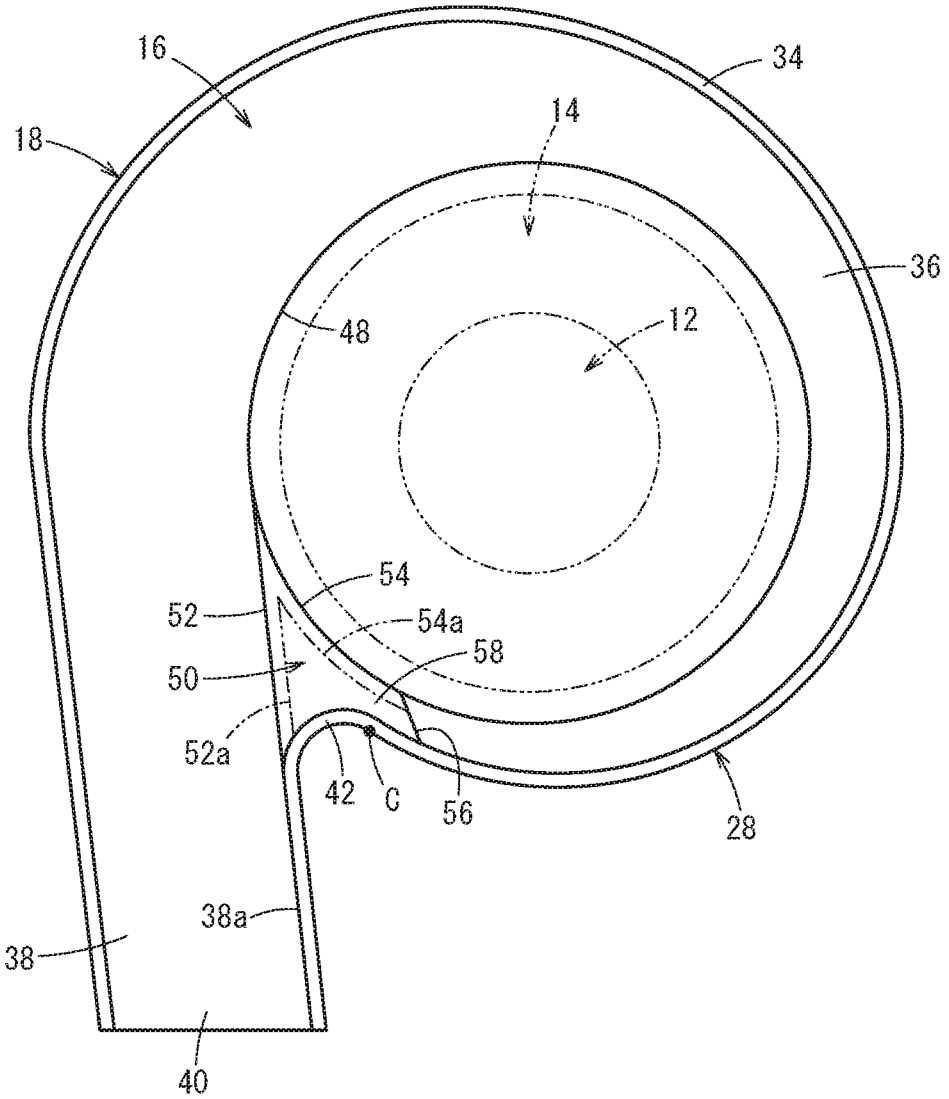
FIG. 3 is an overall plan view of a lower case of the centrifugal air blower shown in FIG. 1.
Figure 4:
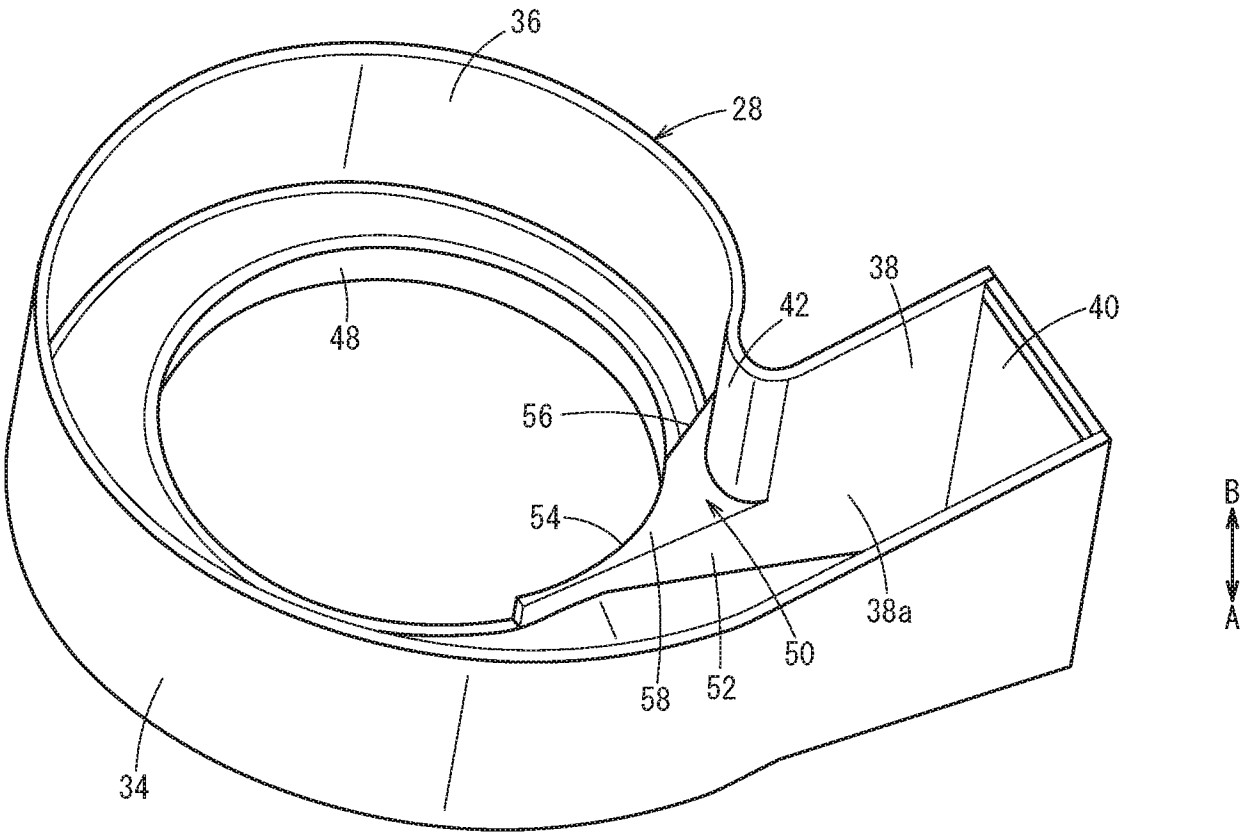
FIG. 4 is a perspective view of an outer appearance of the lower case shown in FIG. 3.

The passage section 16 includes a spiral passage (first passage section) 36 and a discharge passage (second passage section) 38. The spiral passage 36 is formed by both of the upper case 32 and the lower case 34. The spiral passage 36 has a spiral pattern where the outer circumferential wall of the spiral passage 36 is gradually separated radially outwardly away from the fan 14, from a winding start position C (spiral start position) (see FIGS. 1 and 3) toward a winding end position (spiral end position). The discharge passage 38 extends straight in a tangential direction from the winding end position of the spiral passage 36. A discharge port 40 is opened at a downstream end of the discharge passage 38.

Further, the passage section 16 is formed in a manner that the lower wall part is gradually inclined downward (in the direction indicated by the arrow A) from the winding start position C toward the winding end position. In the structure, in the passage section 16, the cross sectional area of the passage gradually gets larger toward the winding end position, and a tongue part 42 is formed to join the winding start position C of the spiral passage 36 and an inner circumferential wall 38*a* of the discharge passage 38.

An air intake port 44 is opened at an upper end of the center of the upper case 32. The air intake port 44 is in the form of a substantially circular opening, and connects the inside with the outside of the casing 18. A bell mouth 46 folded back inward is formed on the outer circumferential portion of the air intake port 44.

An insertion hole 48 is opened at the center of the lower case 34, and a holder 30 is inserted into and held by the insertion hole 48. A land part 50 is formed adjacent to the tongue part 42 of the passage section 16 on the outer circumferential side of the insertion hole 48.

As shown in FIGS. 1 to 4, the land part 50 has, for example, a U-shape in cross section protruding from inner circumferential wall 38*a* of the discharge passage 38 toward the upper case 32 (in the direction indicated by the arrow B in FIG. 2), and has a wide shape that is gradually widened toward the tongue part 42 and the winding start position C of the spiral passage 36, from the inner circumferential wall of the discharge passage 38 toward the downstream side.

In other words, the land part 50 is vertically formed (so as to extend upward) at a location adjacent to the tongue part 42 of the passage section 16, and located between the inner circumferential wall 38*a* of the discharge passage 38 and the insertion hole 48 to which the holder 30 is attached.

The land part 50 includes a first wall 52, a second wall 54, a third wall 56, and a ceiling (top plate) 58. The first wall 52 is vertically formed along the inner circumferential wall 38*a* of the discharge passage 38. The second wall 54 is formed radially inwardly of the first wall 52, along the outer circumference of the insertion hole 48. The third wall 56 extends from an end of the second wall 54 to the outer circumferential wall of the winding start position C of the spiral passage 36. The ceiling 58 covers the upper ends of the first to third walls 52, 54, 56.

For example, this ceiling 58 extends in a substantially horizontal direction perpendicular to the axial direction (directions indicated by arrows A and B in FIG. 2) of the lower case 34. As shown in FIG. 2, the height position of the ceiling 58 in the land part 50 is substantially the same as the height position of the lower end of the fan 14.

The holder 30 includes a cylindrical holder main body 60 housing therein the drive source 12, and a flat part 62 extending radially outwardly from the outer circumferential surface of the holder main body 60. In a state where the holder 30 is inserted into the insertion hole 48 of the lower case 34, the outer peripheral edge of the flat part 62 is connected to the insertion hole 48. As a result, in a state where the flat part 62 faces the lower ends of the blades 22, the insertion hole 48 is closed.

The centrifugal air blower 10 according to the embodiment of the present invention basically has the above-described structure. Next, operation and advantageous effects of the centrifugal air blower 10 will be described below.

Firstly, the drive source 12 is driven based on a control signal from a controller (not shown), and the fan 14 is rotated through the rotary shaft 20 under the driving action of the drive source 12. As a result, air is taken-in from the air intake port 44 opened on an upper portion of the casing 18, and introduced into the inside of the fan 14.

Then, after the air taken in the fan 14 is guided downward and toward the outer circumferential side along the boss 26, the air flows between the plurality of blades 22, and is sent out to the passage section 16 located on the outer circumferential side. The air sent into the passage section 16 flows counterclockwise from the winding start position C along the spiral passage 36, and then reaches the winding end position. Thereafter the air flows through the discharge passage 38 to the discharge port 40. Then, the air is discharged to the outside.

Further, when the air in the above passage section 16 flows in a spiral pattern from the winding start position C of the spiral passage 36 to the discharge passage 38, the pressure of the air is gradually increased. Part of the air may flow from the discharge passage 38 under high pressure in the vicinity of the tongue part 42 into the adjacent winding start position C of the spiral passage 36 under low pressure.

In this case, since the land part 50 is provided between the discharge passage 38 and the winding start position C of the spiral passage 36, and protrudes upward (in the direction indicated by the arrow B), infiltration of moisture or water contained in the air into the inner circumferential side is suppressed. Further, the height position of the land part 50 is substantially the same as the height position of the lower end of the fan 14. Therefore, air which has flowed along the boss 26 of the fan 14 is guided from the lower positions of the blades 22 toward the outer circumferential side. As a result, the moisture or water is pushed back to the outside in the radial direction, and infiltration of the moisture into the inner circumferential side is more reliably prevented.

As a result, on the downstream side of the passage section 16, infiltration of the moisture from the discharge passage 38 into the drive source 12 provided on the inner circumferential side is prevented, and it is possible to suitably prevent occurrence of malfunction of the drive source 12 which would otherwise be caused by such infiltration.

Further, the land part 50 of the above described lower case 34 is not limited to having the U-shape in cross section including the opening at the lower position and the ceiling 58 at the upper position. For example, as shown by a two-dot chain line in FIG. 3, the land part 50 may include a first wall 52*a* is vertically formed (extends upward) on a location adjacent to the discharge passage 38 and a second wall 54*a* is vertically formed (extends upward) on a location adjacent to the outer circumference of the insertion hole 48.

An end of the first wall 52 and an end of the second wall 54 are joined together on the upstream side of the passage section 16 to form a substantially V-shape. Also in the case of adopting this structure, substantially the same advantageous effects as in the case of the land part 50 having the ceiling 58 are obtained.

The centrifugal air blower according to the present invention is not limited to the above described embodiment. It is a matter of course that various structures can be adopted without deviating from the scope of the present invention.

What is claimed is:

1. A centrifugal air blower comprising:

a casing;

a fan housed in the casing and configured to take in an air in an axial direction and send the air in a radial direction; and a drive source housed in the casing and configured to drive the fan, wherein the casing includes:

an air intake port opened at one end of the casing in the axial direction;

an insertion hole, through which the fan is assembled and disassembled;

a flat part extending radially outwardly from a holder main body housing the drive source and connected to the casing to cover the insertion hole;

a spiral first passage section formed on an outer circumferential side of the fan;

a second passage section extending from a spiral end position of the first passage section to a discharge port; and a tongue part formed at a joined portion where a spiral start position of the first passage section and the second passage section are joined together, and wherein the centrifugal air blower further comprises a first wall and a second wall adjacent to the tongue part;

the first wall is vertically formed along an inner circumferential wall of the second passage section so as to extend toward a position closer to the one end of the casing than the flat part in the axial direction; and the second wall is located radially inwardly of the first wall and vertically formed so as to face an outer circumferential surface of the drive source and extend toward a position closer to the one end of the casing than the flat part in the axial direction.

2. The centrifugal air blower according to claim 1, wherein height positions of one end of the first wall and one end of the second wall in the axial direction are substantially same as a height position of another end of the fan in the axial direction.

3. The centrifugal air blower according to claim 2, wherein a ceiling extending substantially perpendicularly to the axial direction is joined to the one end of the first wall and the one end of the second wall in the axial direction.

4. The centrifugal air blower according to claim 3, wherein a land part having a U-shape in cross section comprises the first wall, the second wall, and the ceiling.

* * * * *